United States Patent [19]

Niemelä

[11] Patent Number: 4,819,844

[45] Date of Patent: Apr. 11, 1989

[54] CARRYING STRAP FOR A WEAPON

[76] Inventor: Pekka Niemelä, Säpikäsmutak 2 A, 96440 Rovaniemi 44, Finland

[21] Appl. No.: 18,742

[22] Filed: Jan. 20, 1987

Related U.S. Application Data

[63] Continuation of Ser. No. 787,330, Oct. 15, 1985, abandoned.

[30] Foreign Application Priority Data

Oct. 15, 1984 [FI] Finland ..... 844036

[51] Int. Cl.[4] ..... F41C 33/00

[52] U.S. Cl. ..... 224/150; 224/913

[58] Field of Search ..... 224/913, 150, 202; 24/2, 5

[56] References Cited

U.S. PATENT DOCUMENTS

| | | | |
|---|---|---|---|
| 2,350,484 | 6/1944 | Williams | 224/913 X |
| 2,828,058 | 3/1958 | Arpin | 224/913 X |
| 2,915,233 | 12/1959 | Moomaw | 224/202 X |
| 3,182,871 | 5/1965 | Gossler | 224/149 |
| 3,187,967 | 6/1965 | Somple | 224/150 |
| 3,211,351 | 10/1965 | Somple | 224/913 X |
| 3,606,109 | 9/1971 | Brokus | 224/913 X |
| 4,098,441 | 7/1978 | Campbell | 224/150 |
| 4,299,343 | 11/1981 | Achisson | 224/150 X |
| 4,390,096 | 6/1983 | Goldenberg | 224/202 X |
| 4,555,051 | 11/1985 | Johnson | 224/150 |
| 4,571,872 | 2/1986 | Johnson | 224/150 X |
| 4,691,852 | 9/1987 | Phelps | 224/150 |

OTHER PUBLICATIONS

Adaptor kit top sling 1005 406 1570 dated May 25, 1970 instruction sheet.

*Primary Examiner*—Henry J. Recla
*Assistant Examiner*—Robert Petrik
*Attorney, Agent, or Firm*—Browdy and Neimark

[57] ABSTRACT

A carrying strap for a weapon, attached to the weapon in such manner that it forms a loop intended to be kept across one shoulder and the back, whereby the weapon can be held in front of the person supported by the carrying strap, ready to fire. A drawback of all carrying straps is that the weapon is hanging upside down when in the ready-to-fire position. The carrying strap of the invention has, at least at one attachment point, a laterally stiff strap section so that the center of gravity of the weapon, in correct ready-to-fire position, lies below the line defined by the stiffener and the other attachment point.

5 Claims, 3 Drawing Sheets

CARRYING STRAP FOR A WEAPON

Figure 1:
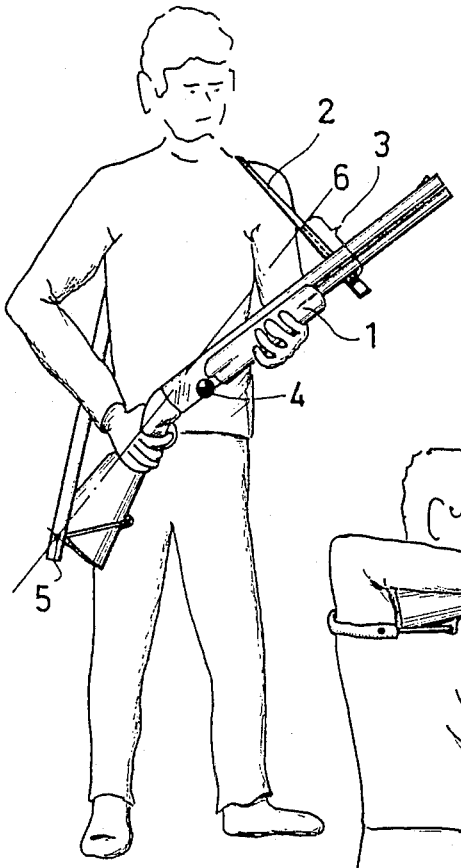

This application is a continuation, of application Ser. No. 787,330, filed Oct. 15, 1985, now abandoned.

The present invention concerns a carrying strap for a weapon, attached to the weapon in such manner that it forms a loop which is intended to be kept across one shoulder and the back, whereby the weapon can be held in readiness for firing in front of the person, supported by the carrying strap.

A drawback in all carrying straps of prior art is that their attachment points are located under the weapon or on its side, causing the weapon to hang upside down. Since, moreover, the carrying strap has to be lifted over the head when moving the weapon from ready-to-fire position to firing position, several time-consuming movements are involved. For instance, in the Finnish patent application No. 832207 is disclosed a design which lengthens the carrying strap when the weapon is moved from ready-to-fire position to firing position. Here, too, the weapon is upside down in the ready-to-fire position. Another drawback of the design is that the clasp means belonging to the strap has be tugged off and this, too, implies an extra movement which furthermore causes an audible clicking sound.

The object of the present invention is to eliminate the drawbacks mentioned. The carrying strap of the invention is charactrerized in that the carrying strap is at least at one attachment point provided with a laterally stiff strap section so that the weapon's centre of gravity in the proper ready-to-fire position comes to lie below the line defined by the stiffener and the other attachment point. With the aid of the invention, the weapon is maintained in correct position all the time and it can rapidly and with ease, and silently be moved from ready-to-fire position to firing position.

An advantageous embodiment of the invention is characterized in that the stiff section of the strap is located at the attachment point on the barrel of the weapon in such manner that it can freely turn from the upper, or ready-to-fire, position down rearward to a position parallelling the barrel, or the firing position. Therefore, it is possible with a simple stiffener to obtain an advantageous carrying strap which is extremely reliable in operation.

A second embodiment of the invention is characterized in that the stiffener consists of a steel wire attached to the strap and pivoted to be turnable about an axle transverse to the longitudinal direction of the weapon at the point of attachment.

A third embodiment of the invention is characterized in that the end of the axle carries an extension parallel to the stiffener and on the end of which has been provided an elongated eye, in which the steel wire is supported permitting a slight free movement in the lateral direction. Therefore, sufficient stiffness is achieved, and the eye allows the stiffener to turn freely to one side enough to provide space for the hand between the stiffener and the weapon, in the firing position.

Furthermore, an embodiment of the invention is characterized in that the attachment of the strap at the stock of the weapon has been so arranged that the attachment point of the strap moves between two points when the weapon is moved from ready-to-fire position to firing position. Therefore, the attachment point at the stock part is also made to move upwards from the attachment point under the stock of the weapon, whereby the weapon can even better be kept in correct position. With this system, so to say, the strap is also lengthened when the weapon is moved from ready-to-fire position to firing position.

An advantageous embodiment of the invention is furthermore characterized in that the strap has been attached to a strap extension resting against an upper point of the stock plate of the weapon and pivotally attached to the attachment point under the stock, this extension preferably consisting of stiff steel wire. This kind of attachment system is simply applicable at the attachment point on the stock of the weapon.

Yet one more embodiment of the invention is characterized in that the strap has been attached with the aid of an eye to a rail at the stock plate, whereby the attachment point can slide between an upper and a lower position. This is another embodiment, which can be mounted e.g. between the stock and the stock plate of the weapon.

The invention is described in the following with the aid of examples, referring to the drawings attached, wherein FIG. 1 presents the weapon in ready-to-fire position.

Figure 2:
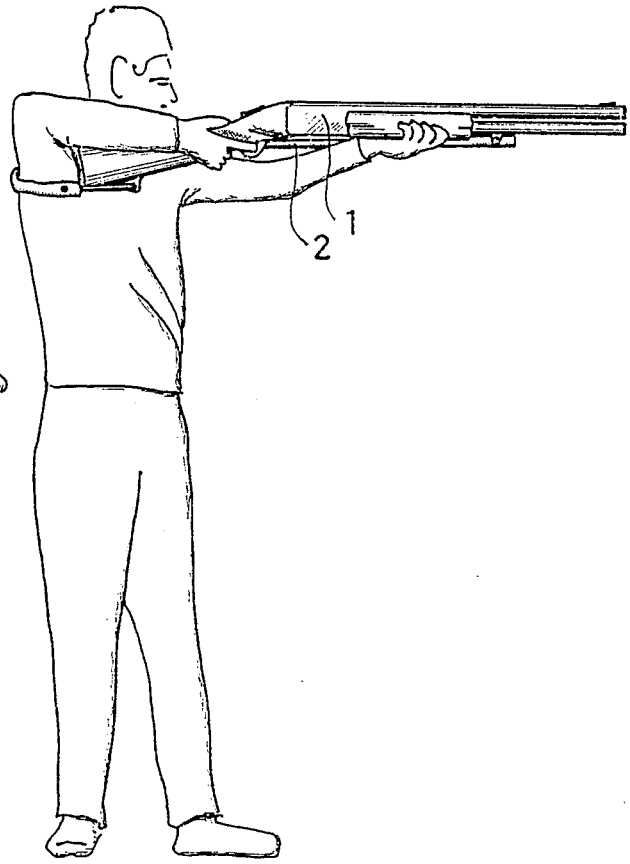

FIG. 2 presents the weapon in firing position.

Figure 3:
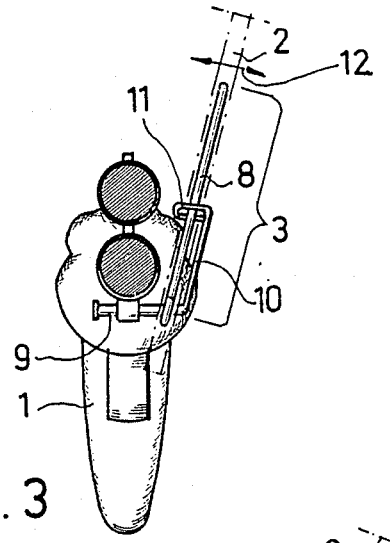

FIG. 3 presents the attachment at the barrel according to an embodiment, viewed from the front of the weapon.

Figure 4:
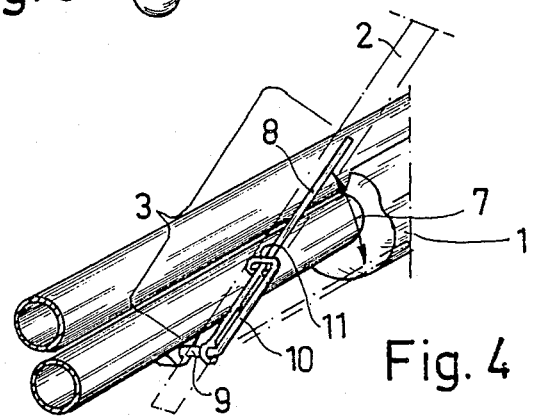

FIG. 4 shows the same as FIG. 3, as viewed obliquely from above.

Figure 5:
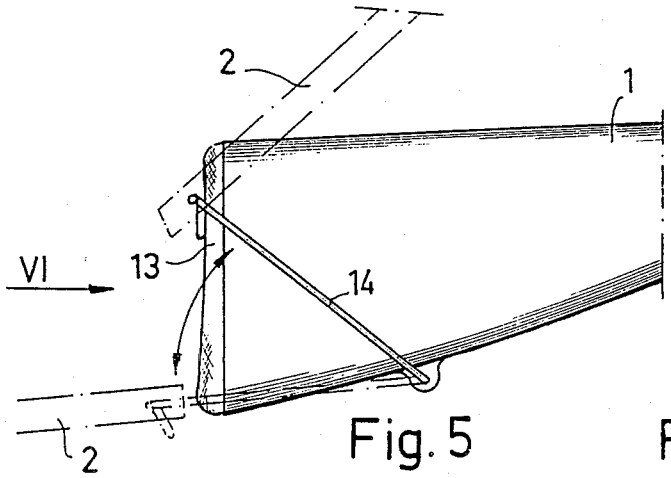

FIG. 5 presents the attachment design according to a certain embodiment, located at the stock of the weapon.

Figure 6:
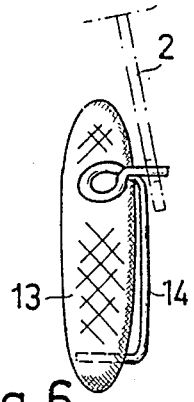

FIG. 6 presents the stock part as viewed in the direction of arrow VI in FIG. 5.

Figure 7:
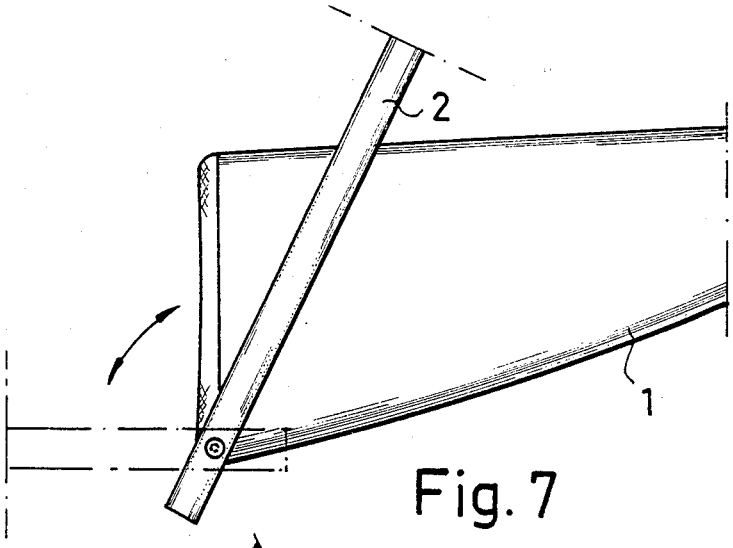

FIG. 7 presents the attachment of the strap to the stock of the weapon according to another embodiment.

Figure 8:
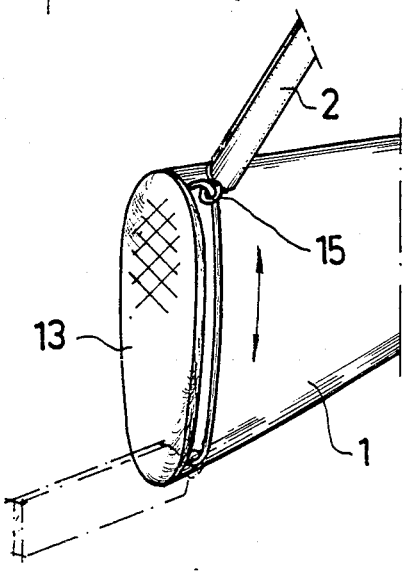

FIG. 8 presents the strap attachment to the stock of the weapon according to a third embodiment.

The carrying strap 2 of the weapon 1 comprises a laterally stiff strap section 3 at one attachment point so that the centre of gravity 4, in correct ready-to-fire position, will lie below the line 6 defined by the stiffener 3 and the other attachment point 5. The stiff section 3 of the strap is disposed at the attachment point on the barrel of the weapon 1 in such manner that it is freely turnable from the upper, or ready-to-fire, position down rearwards to a position parallelling the barrel, or to the firing position, as is shown by arrow 7 in FIG. 4. The stiffener 3 consists of a steel wire 8 attached to the strap 2 and which is pivoted to turn about an axle 9 at the attachment point transverse to the longitudinal direction of the weapon 1. Axle 9 is attached to the barrel via an attaching element as shown in FIG. 3. The axle 9 carries on its end an extension 10 parallelling the stiffener 3 and having on its end an elongated eye 11, in which the steel wire 8 is supported allowing a slight lateral free movement as shown by arrow 12 in FIG. 3. The attachment of the strap 2 at the stock of the weapon 1 has been so arranged that the attachment point of the strap moves between two points when the weapon is moved from ready-to-fire position to firing position. According to FIGS. 5 and 6, the strap has been attached to an extension 14 of the strap 2 resting against an upper point of the stock plate 13 of the weapon 1 and pivotally attached to the attachment point under the stock, this extension consisting of a stiff steel wire.

In FIG. 7, the strap 2 has been attached to a lower point on the stock plate of the weapon, the strap being freely turnable about this attachment point as shown by an arrow. In this embodiment, the stock of the weapon rests against the strap and supports the weapon in the correct position.

In FIG. 8, the end of the strap 2 is provided with an eye 15, by the aid of which the attachment point of the strap can move along a rail at the stock plate 13, between an upper and a lower position.

It is obvious to a person skilled in the art that the invention is not confined to the examples presented in the foregoing but may vary within the scope of the claims presented below. For instance, various stops may be provided on the stiffeners, preventing excessive turning of the stiffeners. It is also possible to provide between the strap and stiffeners various buckles known in themselves in prior art by which the length of the strap can be adjusted. The strap stiffener need not necessarily consist of a separate steel wire attached to the strap: it may equally consist e.g. of glass-fibre or an equivalent reinforced strap.

I claim:

1. A carrying strap for a weapon which is carried in an upright ready to fire position, the strap being attached to the weapon at first and second attachment points on the barrel of the weapon and at the stock of the weapon, respectively, so that said strap forms a loop across the shoulder and back of the person carrying the weapon;

the carrying strap including a stiffener within said strap forming a stiff section, wherein said stiff section is disposed near said first attachment point in such manner that the weapon is free to turn between a lower position and a raised firing position;

said strap further including a first extension resting against an upper point of the stock plate of the weapon and pivotally attached to said second attachment point under the stock, said second attachment point being located at a point forward of the rear of the stock plate such that said first extension pivots between a horizontal position and a position which is inclined with respect to a longitudinal axis of the weapon, said first extension comprising stiff steel wire.

2. A carrying strap according to claim 1, wherein the stiffener is attached to the strap and to an axle passing through an axis transverse to the longitudinal direction of the weapon at said first attachment point, said axle being attached to the weapon such that said stiffener is pivotably attached to said weapon to turn about said axis.

3. A carrying strap according to claim 2, further comprising a second extension paralleling the stiffener located at one end of the axle;

said second extension having on its end an elongated eye through which said stiffener passes.

4. A carrying strap for a weapon, comprising:

a flexible strap adapted to be connected to the weapon;

a first stiff wire section disposed along said flexible strap at a first end thereof;

first attachment means for attaching said flexible strap to the weapon at a first attachment point at the barrel thereof via said first stiff wire section so as to be pivoted about an axle at the first attachment point transverse to the longitudinal direction of the weapon;

an extension adapted to rest against an upper point of a stock plate of the weapon, said extension comprising a second stiff wire section;

second attachment means for pivotally attaching said extension to the weapon at a second attachment point at the stock thereof via said second stiff wire section so that the second attachment point moves between two points when the weapon is moved from a ready-to-fire position to a firing position.

5. In combination, a weapon and a carrying strap for said weapon, comprising:

a gun having a stock at a first end thereof and a barrel at a second end thereof;

a flexible strap having a first end adapted to be connected to said gun at a first attachment point on the barrel and a second end adapted to be connected to said gun at a second attachment point on the stock and adapted to extend of a user's shoulder and behind his back when connected to said gun and worn by the user;

a first stiff wire section disposed along said flexible strap at the first end thereof;

first attachment means for attaching said flexible strap to said gun at the first attachment point at the barrel thereof via said first stiff wire section so as to be pivoted about an axle at the first attachment point transverse to the longitudinal direction of the weapon;

an extension adapted to rest against an upper point of the stock, said extension comprising a second stiff wire section disposed at the second end of said flexible strap;

second attachment means for pivotally attaching said extension to said gun at the second attachment point at the stock thereof via said second stiff wire section wherein the second attachment point moves between two points when said gun is moved from a ready-to-fire position to a firing position, and said extension is inclined across the stock of said gun when said gun is in the ready-to-fire position and said extension extends in a horizontal orientation when said gun is in the firing position.

* * * * *